US008132571B1

(12) United States Patent
Jackson

(10) Patent No.: US 8,132,571 B1
(45) Date of Patent: Mar. 13, 2012

(54) SPIRAL HAIR CURLING IRON

(76) Inventor: Michele M. Jackson, Chicopee, MA (US)

( * ) Notice: Subject to any disclaimer, the term of this patent is extended or adjusted under 35 U.S.C. 154(b) by 608 days.

(21) Appl. No.: 12/287,759

(22) Filed: Oct. 14, 2008

Related U.S. Application Data

(60) Provisional application No. 60/998,366, filed on Oct. 11, 2007.

(51) Int. Cl.

| | |
|---|---|
| ***A45D 7/02*** | (2006.01) |
| ***A45D 1/02*** | (2006.01) |
| ***A45D 2/22*** | (2006.01) |
| ***A45D 1/04*** | (2006.01) |
| ***A45D 2/36*** | (2006.01) |
| ***A45D 4/06*** | (2006.01) |
| ***A45D 4/12*** | (2006.01) |
| ***A45D 20/12*** | (2006.01) |
| ***A45D 20/00*** | (2006.01) |

(52) U.S. Cl. ..... 132/211; 132/227; 219/222; 34/97; 34/283

(58) Field of Classification Search ..... 132/211, 132/200, 203, 206, 207, 210, 227, 228, 229, 132/230, 233, 269, 271, 223, 226, 268; 219/222, 219/225–229; 34/96, 283, 92, 97; 392/379, 392/380, 383–385, 361
See application file for complete search history.

(56) References Cited

U.S. PATENT DOCUMENTS

| | | | | | |
|---|---|---|---|---|---|
| 1,268,848 | A | * | 6/1918 | Jacobs | 132/228 |
| 1,299,008 | A | * | 4/1919 | Neyer | 219/226 |
| 1,369,973 | A | * | 3/1921 | Jacobs et al. | 132/228 |
| 1,614,756 | A | * | 1/1927 | Nessler | 132/230 |
| 1,614,757 | A | * | 1/1927 | Nessler | 132/230 |
| 1,638,302 | A | * | 8/1927 | Gordon | 132/230 |
| 1,643,783 | A | * | 9/1927 | Marcel | 132/230 |
| 1,647,965 | A | * | 11/1927 | Lewis | 132/230 |
| 1,665,472 | A | * | 4/1928 | Opperman | 219/226 |
| 1,843,019 | A | * | 1/1932 | Ferguson | 132/206 |
| 1,847,704 | A | * | 3/1932 | Van Kirk | 132/228 |
| 1,894,624 | A | * | 1/1933 | Marcel | 132/228 |
| 2,030,614 | A | * | 2/1936 | Tobold | 132/228 |
| 2,049,035 | A | * | 7/1936 | Wilsey | 132/206 |
| 2,115,076 | A | * | 4/1938 | Keele | 132/228 |
| 2,753,434 | A | * | 7/1956 | Storm, Jr. | 55/467 |
| 2,791,225 | A | * | 5/1957 | Simmons | 132/210 |
| 2,847,015 | A | | 8/1958 | Davis | |
| 3,213,859 | A | * | 10/1965 | Mizell et al. | 132/210 |
| 3,213,861 | A | * | 10/1965 | Vitello | 132/228 |
| 3,213,863 | A | * | 10/1965 | Underwood | 132/223 |
| 3,223,093 | A | * | 12/1965 | Winters | 132/223 |
| 4,177,824 | A | * | 12/1979 | Gnaga | 132/238 |

(Continued)

*Primary Examiner* — Todd Manahan
*Assistant Examiner* — Vanitha Elgart
(74) *Attorney, Agent, or Firm* — Montgomery Patent & Design, LLC; Robert C. Montgomery; Joseph T. Yaksich

(57) ABSTRACT

A hair curling iron that forms spiral curls having an integral vacuum system and an internal heating tube is designed to eliminate the need for manual rotation of the entire curling iron when forming spiral hair curls. The curling iron provides a slot into which the hair is pulled by an integral vacuum fan mounted within the handle and controlled by an on/off push-button. When activated, the vacuum fan pulls the hair into the curling iron and around an interior heating tube. After several seconds, the pushbutton is released and a spiral curl is pulled out of the curling iron. A separate illuminating switch provides control of the heating portion of the curling iron. The danger of accidental burns is greatly reduced due to the interior location of the hot surfaces.

15 Claims, 7 Drawing Sheets

U.S. PATENT DOCUMENTS

| | | | | | |
|---|---|---|---|---|---|
| 4,464,562 | A | | 8/1984 | Takimae | |
| 4,721,121 | A | * | 1/1988 | Adams | 132/212 |
| 5,267,372 | A | * | 12/1993 | Jones | 15/344 |
| D345,626 | S | | 3/1994 | Izzo | |
| 5,626,156 | A | * | 5/1997 | Vicory, Sr. | 132/229 |
| 5,881,740 | A | | 3/1999 | Lehmann | |
| 5,924,215 | A | * | 7/1999 | Goodsell | 34/98 |
| 5,944,030 | A | | 8/1999 | Kelsey | |
| 6,223,753 | B1 | | 5/2001 | Lo | |
| 6,393,718 | B1 | * | 5/2002 | Harris et al. | 34/96 |
| 6,615,847 | B1 | | 9/2003 | Hagelstam | |
| 6,959,501 | B1 | * | 11/2005 | Melzer | 34/92 |
| 7,082,949 | B2 | | 8/2006 | Julemont | |
| 7,093,376 | B2 | * | 8/2006 | Regen | 34/96 |

* cited by examiner

SPIRAL HAIR CURLING IRON

RELATED APPLICATIONS

The present invention was first described in and claims the benefit of U.S. Provisional Application No. 60/998,366 filed Oct. 11, 2007, the entire disclosures of which are incorporated herein by reference.

FIELD OF THE INVENTION

The present invention relates generally to a multiple tubular container device for mounting thereto a surface and capable of storing a plurality of elongated tubular containers slidingly placed therein corresponding receivers, further comprising a mounting means, a first fixture and a second fixture removably mounted thereto said device, and a handle.

BACKGROUND OF THE INVENTION

Hairstyles are as unique as one's personality. One (1) popular tool used by many to style their hair is that of the curling iron. It is commonly used to add style, body, flips, flair and the like to ones hair in a quick manner with a minimum of fuss. However, to do these tasks, one must grab a swath of hair in the curling iron and then turn the whole iron to wind the hair around the heating tube. This is a task that is easier said than done, especially for younger children, elderly, or those with diminished mobility in their arms. Many times, users accidentally contact the hot heating tube and become burned on their arms and hands areas. Even if one does not burn themselves, the process of curling one's hair takes a valuable amount of time. Accordingly, there is a need for a means by which hair can be curled with a curling iron in a manner without the disadvantages as listed above. The development of the invention herein described fulfills this need.

For special occasions, such as a wedding, it may take hours to get one's hair properly curled. To properly use conventional curling irons requires twisting and holding the apparatus for prolonged periods of time. The contortions required can and frequently do result in the user being burned. A hair curling iron that moves hair into the curling iron for curling on an internally contained heating element alleviates these problems.

There have been attempts in the past to invent curling irons for hair. U.S. Pat. No. 7,082,949 issued to Julemont discloses a hair curler comprising a handle with a clamp and a heating unit. Unfortunately, this patent does not appear to disclose a hair curling iron that comprises a vacuum fan to move hair into an internal cylinder attachment with heating coils contained therein.

U.S. Pat. No. 6,615,847 issued to Hogelstam discloses a hair-waving apparatus and method utilizing heatable leg elements. Unfortunately, this patent does not appear to disclose a spiral hair curling iron comprising a removable cylinder assembly with internal spiral heating elements and a handle assembly with a vacuum fan to move hair into the curling iron for curling.

U.S. Pat. No. 6,223,753 issued to Lo discloses a manual hairdressing and styling device that appears to comprise a clamp like device. Unfortunately, this patent does not appear to disclose a spiral hair curling iron that comprises a fan-driven means to move hair into a detachable cylinder assembly with an internal heating element to curl hair.

U.S. Pat. No. 5,944,030 issued to Kelsey discloses a hair curler comprising an elongated rod with grooves. Unfortunately, this patent does not appear to disclose a spiral hair curling iron comprising a removable cylinder assembly with internal spiral heating elements and a handle assembly with a vacuum fan to move hair into the curling iron for curling.

U.S. Pat. No. 5,881,740 issued to Lehmann discloses a hair curling device for curling the hair of a doll. Unfortunately, this patent does not appear to disclose a spiral hair curling iron for use on humans, nor does this patent appear to disclose a curling iron with a handle assembly that can removably accept different sized cylinder assemblies.

U.S. Pat. No. D 345,626 issued to Izzo discloses a spiral shaped hair curler. Unfortunately, this design patent does not appear to be similar in appearance to the disclosed device, nor does it appear to comprise a detachable cylinder assembly and a handle assembly with a heating coil and fan.

U.S. Pat. No. 4,464,562 issued to Tskimae discloses an electric curling iron with spiral polygonal hair engaging edges comprising a clamp-like curling iron. Unfortunately, this patent does not appear to disclose a spiral hair curling iron that utilizes a vacuum fan to move hair into an internal spiral heating element to produce curls and reduce the chance of burning the user.

U.S. Pat. No. 2,847,015 issued to Davis discloses a hair curler that appears to comprise a spiral shaped curler that hair is wrapped around. Unfortunately, this patent does not appear to disclose a spiral hair curling iron comprising a removable cylinder assembly with internal spiral heating elements and a handle assembly with a vacuum fan to move hair into the curling iron for curling.

SUMMARY OF THE INVENTION

In light of the disadvantages as described in the prior art, it is apparent that there is a need for a spiral hair curling iron which provides a hair curler comprising a cylinder with an integral heating tube in which hair is sucked into by an internal motorized vacuum fan.

It is an object of the spiral hair curling iron to provide an internally spiral shaped passageway to form the curls and in approximately five (5) to seven (7) seconds after arriving in the heating tube, said user's hair conforms to the spiral shape of the heating tube.

Another object of the spiral hair curling iron provides a cylinder assembly with an orifice to receive and guide a user's hair into the heating tube.

A further object of the spiral hair curling iron has a vacuum fan that creates a high-velocity air flow to move a user's hair into the heating tube.

Still another object of the spiral hair curling iron has a cylinder body that may be provided in a plurality of different length models such as long, medium, and short to correspond to various lengths of hair.

Still a further object of the spiral hair curling iron provides for interchangeability of the cylinder assemblies utilizing a common detachable handle assembly.

Yet another object of the spiral hair curling iron reduces the danger of accidental burns due to an interior location of all hot surfaces.

Yet a further object of the spiral hair curling iron is a convenient and compact embodiment due to a removably attachable cylinder assembly portion.

Still another object of the spiral hair curling iron provides a handle body comprising a comfortable cylindrical ergonomic design with a rounded end portion to aid in grasping and is made using heat insulating materials.

Another object of the spiral hair curling iron provides a flexible cord attachment that reduces tangling of the electrical cord during use.

A further object of the spiral hair curling iron may be used for extended periods of time due to the handle body construction that provides protection from heat to a user.

The spiral hair curling iron comprises a filter comprising a disc-shaped screen filtering device to provide a means to filter out particulate matter carried by the air flow, thereby preventing accumulation of dust and hair in the area of the vacuum fan, slidingly removable into a slot located along a top outside surface of the handle body.

An aspect of the spiral hair curling iron comprises a removably attachable cylinder assembly and a handle assembly.

Another aspect of the spiral hair curling iron comprises a cylinder assembly further comprising a stainless steel cylinder body, a locking collar, and a protective end cap. The cylinder assembly provides a joining means to the handle assembly by a locking collar. The locking collar comprises a ring-shaped threaded locking device.

A further aspect of the spiral hair curling iron comprises an orifice, a heating tube, a heating element, and an internal filter. One (1) or more internal heating elements provide a heating means extending along a length of the cylinder body.

Still another aspect of the spiral hair curling iron comprises a handle assembly providing an attachment and housing means to an in-line vacuum fan assembly comprising the fan motor and the fan located within said handle body.

Still a further aspect of the spiral hair curling iron handle assembly comprises an exhaust port comprising a pair of high-flow metal screen panels integrated into the handle body to provide a hot air exhaust means to the apparatus during use.

Yet another aspect of the spiral hair curling iron handle assembly comprises a power cord further comprising a durable attachment to said handle assembly by a common grooved flexible connection molded to said power cord, allowing omni-directional movement of the apparatus during hair styling.

A further aspect of the spiral hair curling iron comprises a handle assembly further comprising a heater switch and a fan switch. The fan switch comprises a rocker type switch providing an ON/OFF function to the internal fan motor and comprising a spring return function to an OFF state, thereby requiring a user to continually press thereupon said fan switch to activate the fan function during use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
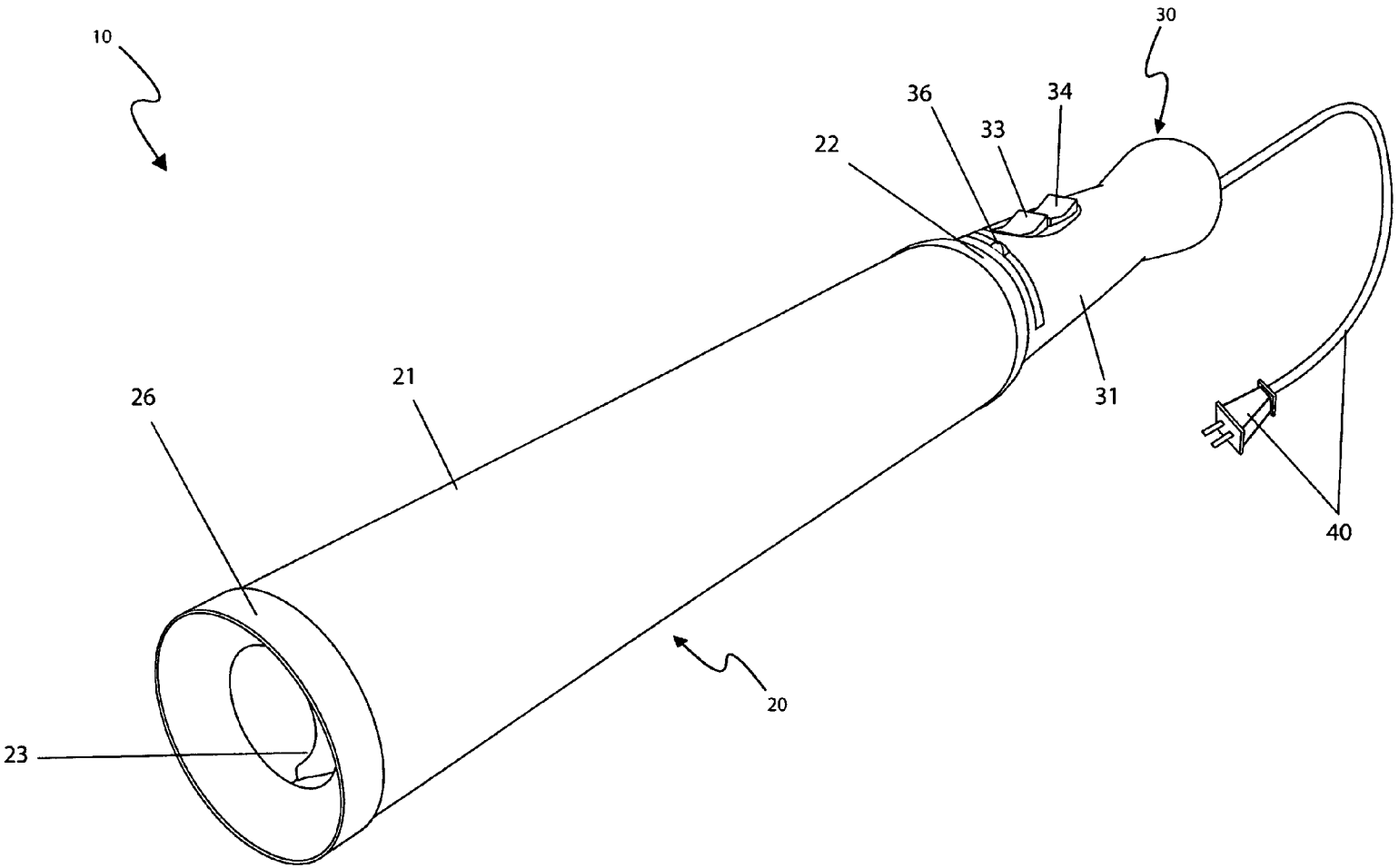
FIG. 1 is a front perspective view of a spiral hair curling iron 10, according to a preferred embodiment of the present invention.

| DESCRIPTIVE KEY | |
|---|---|
| 10 | spiral hair curling iron |
| 19 | retaining groove |
| 20 | cylinder assembly |
| 21 | cylinder body |
| 22 | locking collar |
| 23 | orifice |
| 24 | heating tube |
| 25 | heating element |
| 26 | end cap |
| 27 | retaining ring |
| 28 | female threaded portion |
| 29 | male threaded portion |
| 30 | handle assembly |
| 31 | handle body |
| 33 | heater switch |
| 34 | fan switch |
| 35 | exhaust port |
| 36 | filter |
| 37 | tab feature |
| 38 | air tube |
| 40 | power cord |
| 41 | flexible connection |
| 45 | male connector |
| 46 | female connector |
| 50 | vacuum fan motor |
| 56 | vacuum fan |
| 57 | air flow |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a spiral hair curling iron (herein described as the "apparatus") 10, which provides a hair curler comprising a cylinder 20 with an integral heating tube 24 in which hair is drawn thereinto by an internal motorized vacuum fan 56. The vacuum fan 56 is mounted internal therein a handle assembly portion 30 of the apparatus 10 and controlled by an on/off switch 34. When activated, the vacuum fan 56 pulls hair into a spiral-shaped interior heating tube 24. After a suitable period of time, the fan switch 34 is released and a perfect curl is pulled out of the heating tube 24. The danger of accidental burns is greatly reduced due to an interior location of hot surfaces.

Referring now to FIG. 1, a front perspective view of the apparatus 10, according to the preferred embodiment of the present invention, is disclosed. The apparatus 10 comprises a cylinder assembly 20 and a handle assembly 30. The apparatus 10 provides a convenient and compact embodiment via a removably attachable cylinder assembly portion 20. The cylinder assembly 20 further comprises a stainless steel cylinder body 21, a locking collar 22, and a protective end cap 26. The cylinder body 21 comprises a removably attachable cylindrical metal enclosure approximately two (2) inches in diameter and twelve (12) inches long. The cylinder body 21 may be provided in a plurality of different length models such as long, medium, and short which correspond to various lengths of hair. Said different length cylinder body units 21 would utilize a common detachable handle assembly 30 (see FIG. 2*a*). The cylinder assembly 20 comprises a protective end cap 26 at a proximal end thereof being affixed thereto using common fasteners or high-temperature adhesives. The end cap 26 provides protection thereto a user from contacting a warm surface of the cylinder body 21 during use. The cylinder assembly 20 also provides a joining means thereto the handle assembly 30 via a locking collar 22. The locking collar 22 comprises a ring-shaped threaded locking device (see FIG. 2*b*).

Figure 2A:
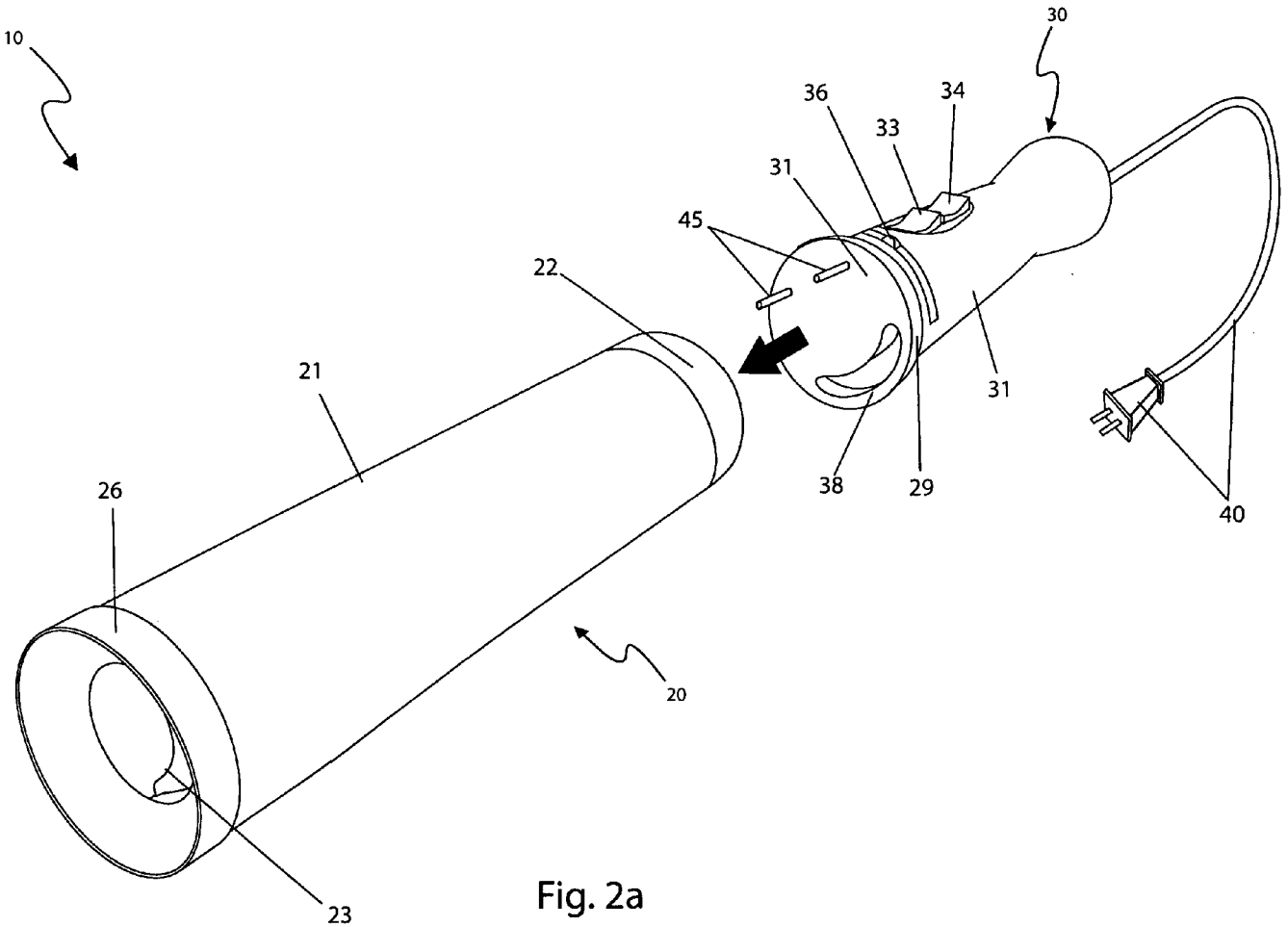
FIG. 2*a* is an exploded view of the spiral hair curling iron 10 in a detached state, according to a preferred embodiment of the present invention.

Referring now to FIG. 2*a*, an exploded view of the apparatus 10, according to the preferred embodiment of the present invention 10, is disclosed. The apparatus 10 comprises a handle assembly 30 further comprising a handle body 31, a heater switch 33, and a fan switch 34. The handle body 31 comprises a comfortable cylindrical ergonomic design with a rounded end portion to aid in grasping and is envisioned being made using heat insulating materials such as dense foam-rubber, plastic, or the like. The handle body 31 provides protection from heat, thereby allowing extended use of the apparatus 10 by a user. The handle body 31 also provides a mounting means thereto a heater switch 33 and a fan switch 34 along an upper surface via molded-in retaining features. The heater switch 33 comprises a common illuminated two-position rocker switch which provides an ON/OFF function thereto one (1) or more internal heating elements 25 (see FIG. 4*a*). When switched to the ON position, said heater switch 33 illuminates to indicate initiation of a heating of the apparatus 10 until switched thereto the OFF position. The fan switch 34 comprises a rocker-type switch providing an ON/OFF function thereto the internal fan motor 56 (see FIG. 3). The fan switch 34 comprises a similar rocker design as the aforementioned heater switch 33; however, said fan switch 34 provides a spring return function thereto an OFF state, thereby requiring a user to continually press thereupon said fan switch 34 to activate the fan 56 function during use.

Figure 2B:
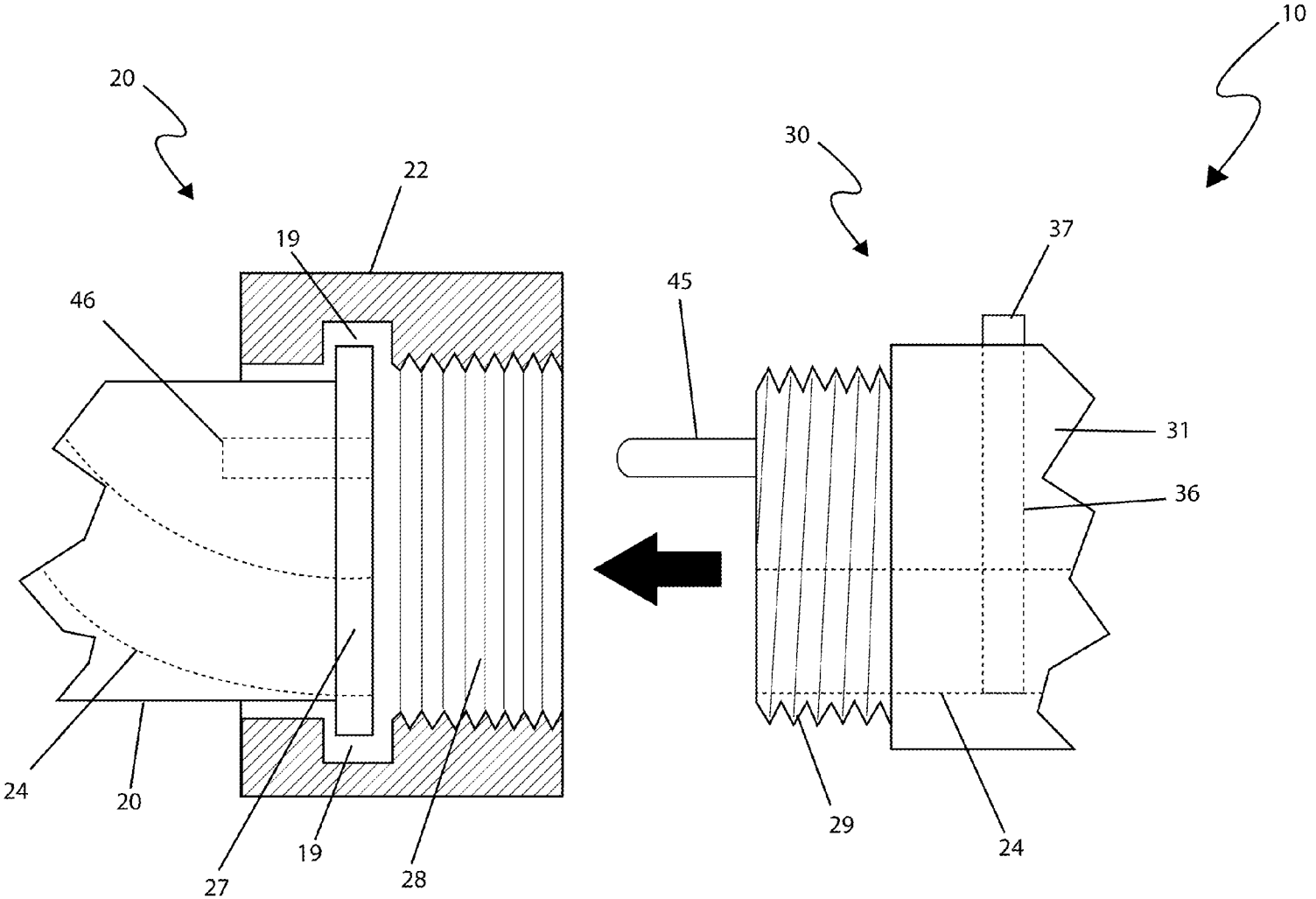
FIG. 2*b* is a partial cut-away view of the locking collar portion 22 of the spiral hair curling iron 10, according to a preferred embodiment of the present invention.

Referring now to FIG. 2*b*, a partial cut-away view of the locking collar portion 22 of the apparatus 10, according to a preferred embodiment of the present invention, is disclosed. The apparatus 10 comprises a locking collar 22, a retaining ring 27, a male threaded portion 28, a female threaded portion 29, a pair of male connectors 45, and a pair of female connectors 46. Attachment therebetween the cylinder assembly 20 and handle assembly 30 as well as securing the connectors 32 is accomplished using a common locking collar design being similar to a plumbing union fitting. The cylinder assembly 20 comprises an integral retaining ring feature 27 retained therein a circumferential retaining groove 19 located along an interior surface of the locking collar 22. The retaining ring 27 retains the locking collar 22 thereat a fixed lateral position while providing rotating mechanical communication thereto. Said locking collar 22 further comprises an interior female threaded portion 28. The handle assembly 30 comprises a corresponding male threaded portion 29, thereby providing a threading attachment thereto said female threaded portion 28 of the cylinder assembly 20 via threaded engagement of the locking collar 22 in an expected manner. The male 45 and female 46 connectors provide conduction of electric current therefrom circuitry internal to the handle body 31 thereto heating elements 25 located within the cylinder body 21 (see FIGS. 4*b* and 5). The male 45 and female 46 connectors comprise standard inserting banana-type connections or equivalent electrical connecting components being able to provide sufficient current carrying capability.

Figure 3:
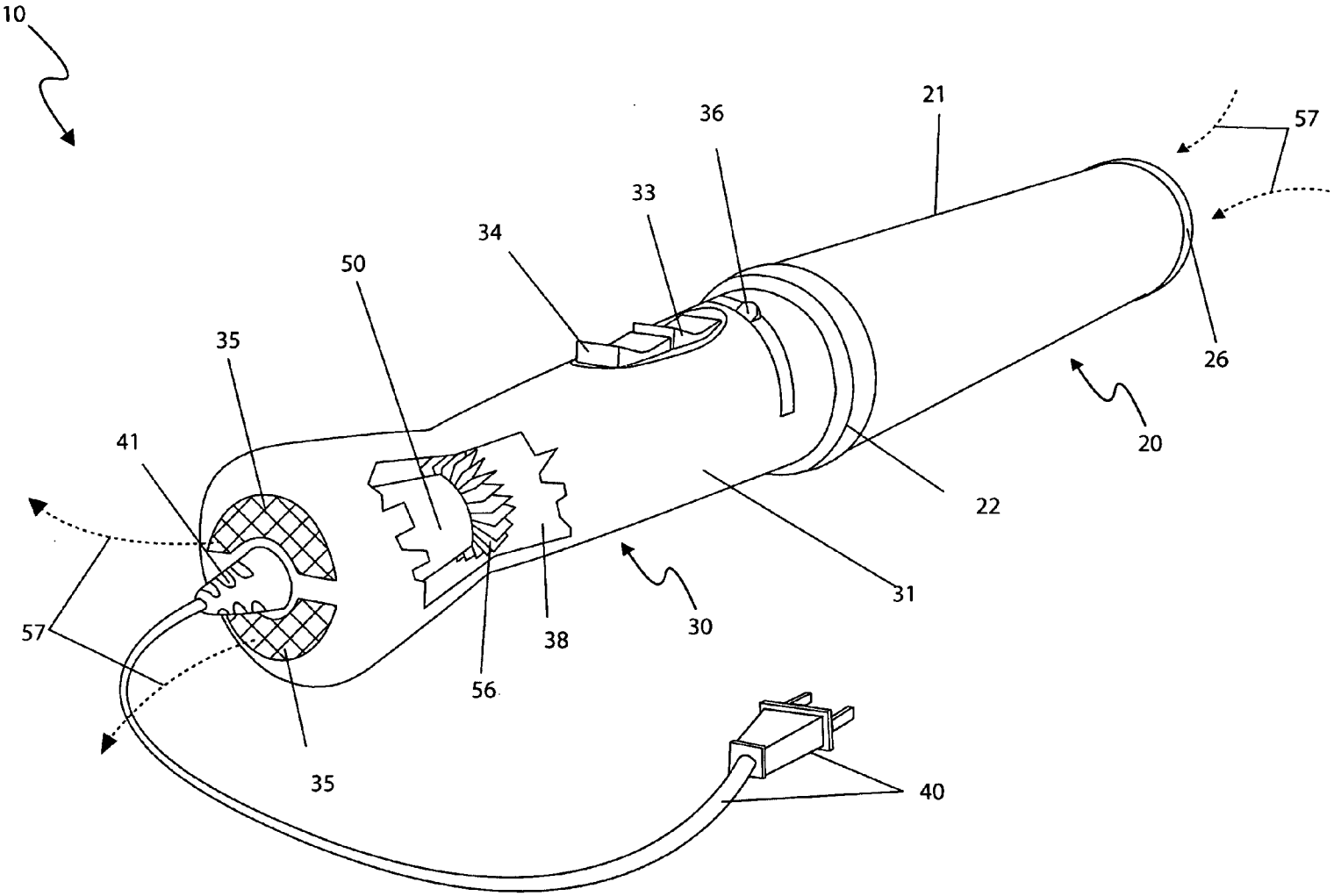
FIG. 3 is a partial cut-away view of the spiral hair curling iron 10, according to a preferred embodiment of the present invention.

Referring now to FIG. 3, a partial cut-away view of the apparatus 10, according to the preferred embodiment of the present invention 10, is disclosed. The apparatus 10 comprises an exhaust port 35, a power cord 40, a flexible connector 41, a fan motor 50, a fan 56, and an air tube 38. The handle 30 provides an attachment and housing means to an in-line vacuum fan assembly comprising the fan motor 50 and the fan 56 located therewithin an internal cylindrical air tube 38 portion of said handle body 31. The fan motor 50 comprises an internally-mounted miniature electric motor unit in direct mechanical communication therewith the fan 56 via an output shaft. The fan 56 comprises a common miniature multi-blade directional impeller having a slightly smaller diameter than that of the air tube 38, thereby providing an efficient air flow pressure. When activated, said fan motor 50 and fan 56 draw an air flow 57 into the cylinder assembly 20, through the air tube 38, and exhausts said air flow 57 out an exhaust port 35 located along a rear surface of the handle body 31. The exhaust port 35 provides a hot air exhaust means to the apparatus 10 during use. The exhaust port 35 comprises a pair of high-flow metal screen panels integrated thereinto the handle body 31. Said exhaust port 35 provides sufficient open area so as to allow maximum air flow 57 therethrough. Upon activation, the fan motor 50 and fan 56 provides a vacuum air flow 57 allowing a user's hair to be drawn thereinto an orifice portion 23 of the cylinder assembly 20 (see FIG. 4*a*). The handle assembly 30 also provides an attachment means thereto a common power cord 40 which in-turn provides a 110-volt electrical current thereto the apparatus 10 via an available household electrical outlet. The power cord 40 comprises a durable attachment thereto said handle assembly 30 via a common grooved flexible connection 41 being molded thereto said power cord 40, thereby allowing omni-directional movement of the apparatus 10 during hair styling.

Figure 4A:
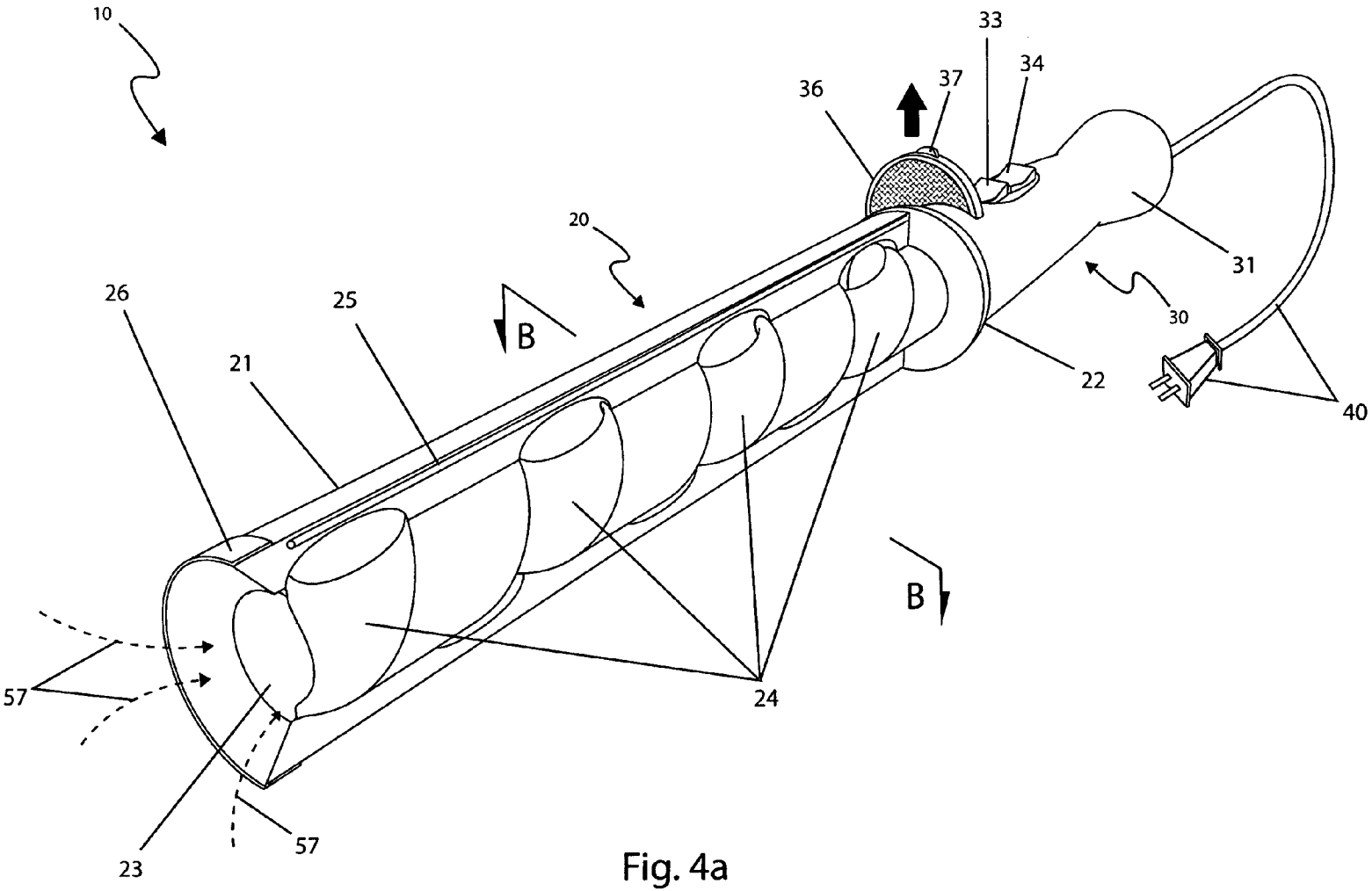
FIG. 4*a* is a cut-away view of a cylinder assembly portion 20 of the spiral hair curling iron 10, according to a preferred embodiment of the present invention.
Figure 4B:
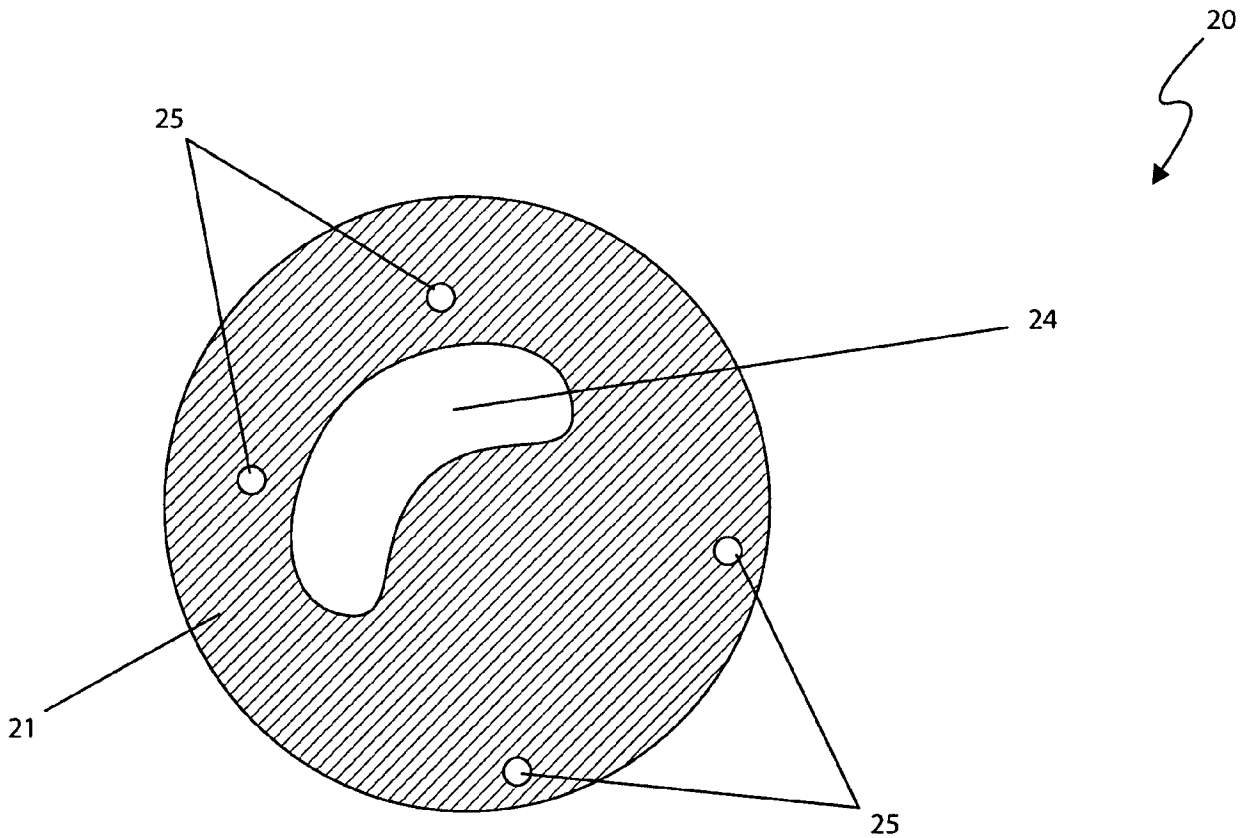
FIG. 4*b* is a section view taken along section line B-B of the spiral hair curling iron 10 (see FIG. 4*a*), according to a preferred embodiment of the present invention; and, FIG. 5 is an electrical block diagram of the spiral hair curling iron 10, according to a preferred embodiment of the present invention.

Referring now to FIGS. 4*a* and 4*b*, cut-away and section views of a cylinder assembly portion 20 of the apparatus 10, according to a preferred embodiment of the present invention, are disclosed. The apparatus 10 further comprises an orifice 23, a heating tube 24, a heating element 25, and an internal filter 36. The cylinder body 21 comprises one (1) or more internal heating elements 25 which provide a heating means extending along a length of the cylinder body 21. Each heating element 25 is envisioned to be a commercially available heating component such as a cylindrical cartridge unit, a cable heater, or equivalent linear device envisioned to be made of stainless steel, ceramic materials, or other suitable heater materials common in the industry. The cylinder assembly 20 further comprises an orifice 23 which provides a receiving and guiding means thereto a user's hair entering the heating tube 24. Said hair is motivated by an inwardly moving high-velocity air flow 57 resulting from activation of the vacuum fan 56 (see FIG. 3). Said user's hair then proceeds into the heating tube 24 which comprises an internal spiral shaped passageway approximately one (1) inch wide which extends internally therethrough the cylinder body 21, the locking collar 22, the male 29 and female 28 threaded portions, and the handle body 31 (see FIG. 2*b*). In approximately five (5) to seven (7) seconds after arriving in the heating tube 24, said user's hair conforms to the spiral shape of the heating tube 24, thereby accomplishing a desired curling effect. The cylinder body 21 and the heating tube 24 are envisioned being preferably made using polished stainless steel; however, other low-friction materials may be used such as steel coated with a synthetic polymeric lubricant such as TEFLON®, anodized aluminum, or the like, thereby providing similar heat conducting and low-friction properties. The filter 36 comprises a disc-shaped screen filtering device providing a means to filter out particulate matter carried by the air flow 57, thereby preventing accumulation of dust and hair in the area of the vacuum fan 56. The filter 36 is envisioned to be an easily cleaned circular screen type device with a plastic frame located internal thereto the handle body 31 and being perpendicular thereto the air flow 57. The filter 36 is also envisioned to be approximately two (2) inches in diameter being slidingly removably inserted thereinto a slot located along a top outside surface of the handle body 31 and easy lifted therefrom using a molded-in tab feature 37 for periodic cleaning.

Figure 5:
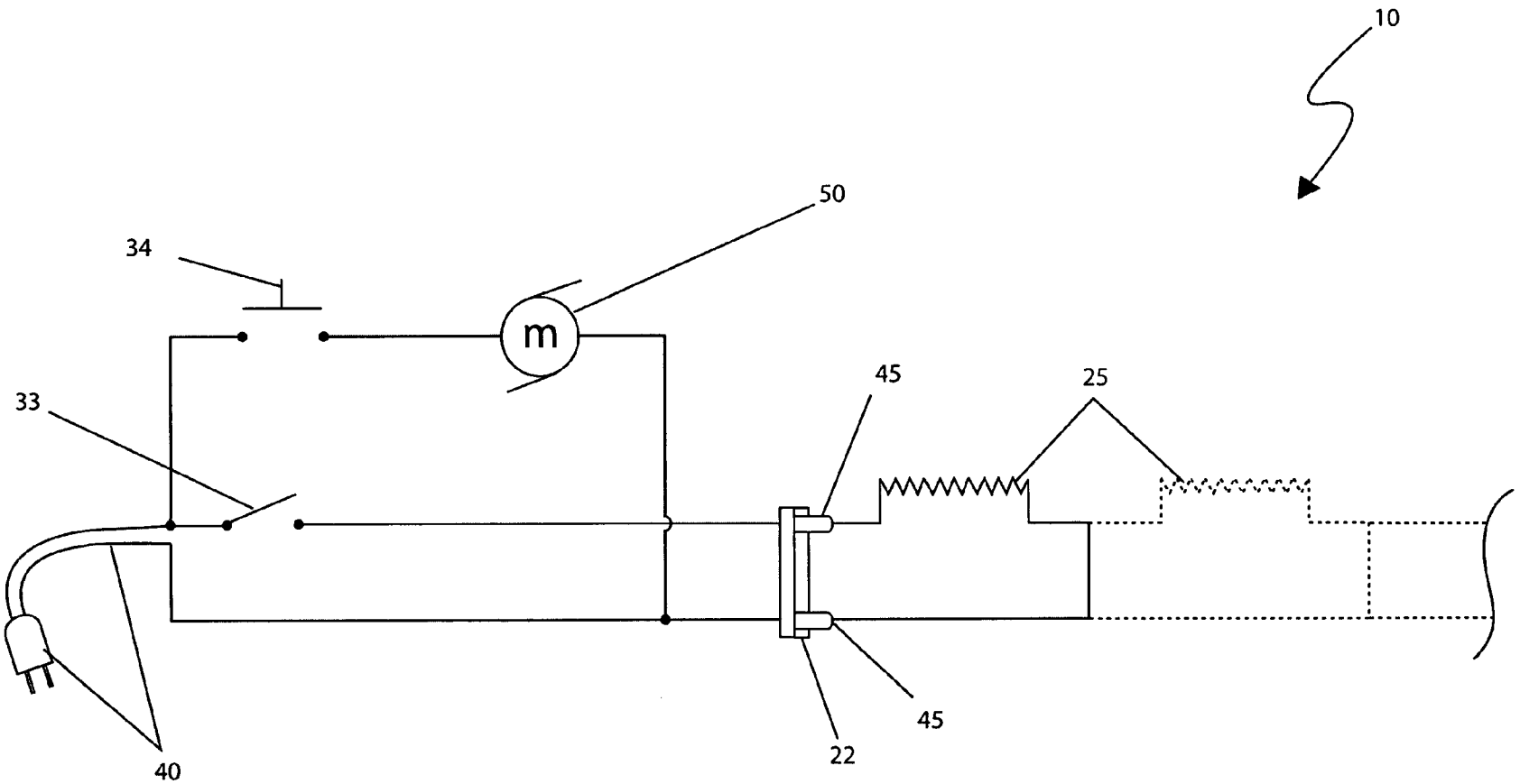

Referring now to FIG. 5, an electrical block diagram of the apparatus 10, according to the preferred embodiment of the present invention, is disclosed. The apparatus 10 receives 110-volt power via a common electrical power cord 40 utilizing an available household circuit. Power is internally directed thereto two (2) independent circuits. The first circuit provides current to a vacuum fan motor 50 being controlled by a momentary single pole-single throw (SPST) pushbutton switch 34. The second circuit provides current to one (1) or more parallel-wired heating elements 25 via a pair of heavy-duty male 45 connectors of sufficient current carrying capability. The second circuit is controlled using a toggle-type SPST switch 33.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of utilizing the apparatus 10 may be achieved by performing the following steps: connecting the handle assembly 30 thereto the cylinder assembly 20 by engaging the male connectors 45 therewith the mating female connectors 46 and manually rotating the locking collar 22 to secure thereto wherein the retaining ring 27 retains the interconnected male 45 and female 46 connectors; inserting the filter 36 into the handle body 31; plugging the apparatus 10 into a household circuit using the power cord 40; activating the heating elements 25 using the heater switch 33; waiting for the cylinder assembly 20 to reach a desirable temperature; activating the vacuum fan 56 using the fan switch 34 to establish an air flow 57; manually inserting a user's hair into the orifice 23 via the vacuum effect of the air flow 57; continuing to insert said hair into the heating tube 24 to a desired length; pausing five (5) to seven (7) seconds to allow said hair to take a curl; releasing the vacuum fan switch 34; withdrawing the apparatus 10 therefrom said user's hair, thereby producing a spiral shaped curl; repeating the curling process as desired until finished; turning off the heater switch 33 and allowing the apparatus 10 to cool; storing the apparatus 10 in a drawer, purse, or other convenient place until again needed; and, enjoying the professional hair styling results afforded a user of the present invention 10 in a quick, safe, and convenient manner.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hair curling iron comprising:

a handle assembly, further comprising:

a handle body comprising a cylindrical ergonomic design with a rounded end portion comprising heat insulating materials and further comprising a male threaded portion at a front end, a heater switch mounted to an upper surface of said handle body and in electrical communication with a power cord;

a pair of male connectors extending outwardly from said front end and in electrical communication with said heater switch;

a fan switch mounted to an upper surface of said handle body adjacent to said heater switch and in electrical communication with said power cord;

a mounting means for a vacuum fan;

a flexible connector for said power cord extending outwardly from said rear end, said power cord removably connected to a power source; and, an exhaust port located along a rear surface of said handle body;

said vacuum fan housed within said handle assembly, further comprising:

a fan motor in electrical communication with said fan switch;

a fan driven by said fan motor via an output shaft, further comprising a multi-blade directional impeller; and, an air tube located at a fan intake;

wherein said impeller comprises a diameter slightly smaller than said air tube, thereby providing an efficient air flow pressure;

wherein when activated, said fan motor drives said fan which draws an air flow therein said cylinder assembly, therein said heating tube, therein said air tube of said handle assembly, and exhausts said air flow through said exhaust port;

an internal filter slidingly insertable into a filter slot along an outside surface of said handle assembly;

wherein when said filter is inserted, said filter is suspended in said air tube;

wherein said filter provides a means to filter out particulate matter carried by said air flow, thereby preventing accumulation of dust and hair in said vacuum fan;

a cylinder assembly removably attachable to said handle assembly, further comprising:

a cylinder body, comprising a distal end and a proximal end;

a coupling assembly located at said distal end of said cylinder body, comprising a locking collar comprising a female threaded portion, a retaining ring retained in a circumferential retaining groove located along an interior surface of said locking collar, said retaining ring comprising an opening providing a fluid communication between a first heating tube body and a second heating tube body, and a pair of female connectors for receiving said pair of male connectors; and, a protective end cap affixed to said proximal end of said cylinder body;

wherein said coupling assembly provides a joining means to said handle assembly; and, wherein said protective end cap provides protection to a user from contacting a warm surface of said cylinder body during use;

wherein said female threaded portion receives said male threaded portion of said handle body to provide said joining means; and, wherein said retaining ring retains said locking collar at a fixed lateral position while providing rotating mechanical communication thereto;

wherein when said male and female connectors are interconnected, they provide conduction of electric current from said handle assembly to said at least one heating element;

a heating tube housed within said cylinder assembly and said handle assembly and further comprising at least one heating element;

wherein said handle body provides protection from heat, thereby allowing extended use thereby a user;

wherein said heater switch provides an ON/OFF function thereto said at least one heating element;

wherein said fan switch providing an ON/OFF function to said vacuum fan;

wherein said exhaust port provides a hot air exhaust means during use; and, wherein said exhaust port provides sufficient open area so as to allow maximum air flow therethrough wherein hair is drawn into said heating tube induced by said vacuum fan;

wherein said hair curling iron imparts heat thereto said at least one heating element;

wherein said at least one heating element provides a heating means extending along a length of said cylinder assembly;

wherein said heating tube creates a curl of said hair when released; and, wherein accidental burns are greatly reduced due to an interior location of hot surfaces.

2. The hair curling iron of claim 1, wherein said heater switch further comprises a common illuminated two-position rocker switch;

wherein when said heater switch is switched to an ON position, said heater switch illuminates to indicate initiation of a heating of said hair curling iron until switched to an OFF position.

3. The hair curling iron of claim 1, wherein said fan switch further comprises a rocker-type switch;

wherein said fan switch provides a spring-return function to an OFF state, thereby requiring a user to continually press thereupon said fan switch to activate said vacuum fan.

4. The hair curling iron of claim 1, wherein said exhaust port further comprises a pair of high-flow metal screen panels integrated into said handle body.

5. The hair curling iron of claim 1, wherein said filter comprises a circular screen with a frame located internal to said handle body and being perpendicular to said air flow and further comprising a tab feature providing an insertion and removal means.

6. The hair curling iron of claim 1, wherein said heating tube further comprises:

an orifice located at said proximal end of said cylinder assembly;

said first heating tube body comprising an internal spiral-shaped passageway extending internally through said handle body to said air tube;

said second heating tube body comprising an internal spiral-shaped passageway extending internally through said cylinder body; and, said at least one heating element in electrical communication said pair of female connectors;

wherein said orifice provides a receiving and guiding means to a user's hair entering said heating tube;

wherein said hair is drawn into said second heating tube body and said first heating tube body until an elapsed time occurs, wherein said hair conforms to said spiral-shaped passageway.

7. The hair curling iron of claim 6, wherein said at least one heating element comprises a cylindrical cartridge unit.

8. The hair curling iron of claim 6, wherein said at least one heating element comprises a cable heater.

9. The hair curling iron of claim 6, wherein said elapsed time comprises approximately five to seven seconds after arriving in said second heating tube.

10. The hair curling iron of claim 6, wherein said cylinder body and said heating tube comprise a polished stainless steel article of manufacture.

11. The hair curling iron of claim 6, wherein said cylinder body and said heating tube comprise a TEFLON®-coated steel article of manufacture.

12. The hair curling iron of claim 6, wherein said cylinder body and said heating tube comprise an anodized aluminum article of manufacture.

13. The hair curling iron of claim 6, wherein said cylinder body comprises approximately two inches in diameter and twelve inches in length.

14. The hair curling iron of claim 6, wherein said filter comprises approximately two inches in diameter.

15. A method of producing a curling effect to hair utilizing a hair curling iron comprises the following steps:

providing said hair curling iron comprising:

a handle assembly, further comprising:

a handle body comprising a cylindrical ergonomic design with a rounded end portion comprising heat insulating materials and further comprising a male threaded portion at a front end, a heater switch mounted to an upper surface of said handle body and in electrical communication a power cord;

a pair of male connectors extending outwardly from said front end and in electrical communication said heater switch;

a fan switch mounted to an upper surface of said handle body adjacent to said heater switch and in electrical communication said power cord;

a mounting means for a vacuum fan;

a filter slidingly insertable into a filter slot along an outside surface of said handle assembly such that said filter is perpendicular to an air flow and further comprising a tab feature providing an insertion and removal means;

a flexible connector for said power cord extending outwardly from said rear end, said power cord removably connected to a power source; and, an exhaust port located along a rear surface of said handle body;

said vacuum fan housed within said handle assembly, further comprising:

a fan motor in electrical communication said fan switch;

a fan driven by said fan motor via an output shaft, further comprising a multi-blade directional impeller; and, an air tube located at a fan intake;

a cylinder assembly removably attachable to said handle assembly, further comprising:

a cylinder body, comprising a distal end and a proximal end;

a locking collar comprising a female threaded portion located at said distal end;

a retaining ring retained in a circumferential retaining groove located along an interior surface of said locking collar, said retaining ring comprising an opening providing a fluid communication between a first heating tube body and a second heating tube body;

a pair of female connectors for receiving said pair of male connectors; and, a protective end cap affixed to said proximal end of said cylinder body;

a heating tube housed within said cylinder assembly and said handle assembly and further comprising:

an orifice located at said proximal end of said cylinder assembly;

said first heating tube body comprising an internal spiral-shaped passageway extending internally through said handle body to said air tube;

said second heating tube body comprising an internal spiral-shaped passageway extending internally through said cylinder body; and, at least one heating element in electrical communication said pair of female connectors;

connecting said handle assembly to said cylinder assembly by mating said pair of male connectors said pair of female connectors and manually rotating said locking collar to secure to, wherein said retaining ring retains said interconnected pair of male connectors and pair of female connectors;

inserting said filter into said handle body;

connecting said power cord to said power source;

activating said at least one heating element using said heater switch;

waiting for said cylinder assembly to reach a desirable temperature;

activating said vacuum fan using said fan switch to establish said air flow, wherein said fan motor rotates said fan;

manually inserting hair into said orifice assisted by a vacuum effect of said air flow, wherein said hair is drawn into said heating tube;

continuing to insert said hair into said heating tube to a desired length;

waiting for an elapsed time to allow said hair to properly conform to said spiral-shaped passageway, thereby producing a curl;

releasing said fan switch, thereby ceasing power to said fan motor;

withdrawing said hair from said heating tube and said orifice;

repeating producing said curl to additional amounts of hair as desired until a desired amount of curls is produced;

turning off said heater switch and allowing said hair curling iron to cool; and, storing said hair curling iron in a convenient place until subsequent use.

* * * * *